US007241153B2

(12) United States Patent
He et al.

(10) Patent No.: US 7,241,153 B2
(45) Date of Patent: Jul. 10, 2007

(54) PORTABLE STORAGE DEVICE WITH PROTECTIVE CAP

(75) Inventors: Jia-Yong He, Kunshan (CN); Qi-Jun Zhao, Kunshan (CN); Mao-Lin Lei, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 55 days.

(21) Appl. No.: 11/384,879

(22) Filed: Mar. 20, 2006

(65) Prior Publication Data

US 2006/0211279 A1 Sep. 21, 2006

(30) Foreign Application Priority Data

Mar. 18, 2005 (CN) ..... 2005 2 0069981

(51) Int. Cl.
*H01R 13/44* (2006.01)

(52) U.S. Cl. ..... 439/148; 439/353

(58) Field of Classification Search ..... 439/135, 439/136, 148, 353, 357
See application file for complete search history.

(56) References Cited

U.S. PATENT DOCUMENTS

| | | | | |
|---|---|---|---|---|
| 6,508,678 | B1 * | 1/2003 | Yang | 439/677 |
| 6,522,534 | B1 | 2/2003 | Wu | |
| 6,612,853 | B2 | 9/2003 | Wu | |
| 6,808,400 | B2 | 10/2004 | Tu | |
| 6,902,432 | B2 * | 6/2005 | Morikawa et al. | 439/607 |
| 6,926,544 | B2 | 8/2005 | Lee | |
| 6,999,322 | B1 * | 2/2006 | Lin | 361/752 |
| 7,014,490 | B1 * | 3/2006 | Morikawa et al. | 439/352 |

* cited by examiner

*Primary Examiner*—Thanh-Tam Le
(74) *Attorney, Agent, or Firm*—Wei Te Chung

(57) ABSTRACT

A portable storage device (1) includes a memory device with a USB interface (20) and a protective cap (30) detachably mated with the USB interface. The USB interface may be a conventional one, which has a metal shell (21) defined pair of holes (213) therein. The protective cap has a case (31), a spring member (34) mounted therein and a button (33) engaged the spring member. The spring member defines a hook section (343) thereon to engage with the hole of the USB interface. To press said button inwardly disengages the hook section of the spring member from the hole of the USB connector, thereby detaching the USB interface from the cap.

16 Claims, 8 Drawing Sheets

PORTABLE STORAGE DEVICE WITH PROTECTIVE CAP

BACKGROUND OF THE INVENTION

1. Field of the Invention

The present invention generally relates to a portable storage device, and particularly to a portable storage device with a protective cap which can protect connector of the portable storage device.

2. Description of Related Art

Please refer to FIG. 8, which is a schematic diagram of a conventional portable storage device. The portable storage device includes a case 16, a USB connector 14, and a cover 12 detachably connected to the case 16 to cover the USB connector 14.

The case 16 of the above-described conventional portable storage device is internally provided with circuits for storing and transmitting computer data, and is electrically connected to the connector 14, such that when the cover 12 is removed from the case 16 to expose the connector 14, the connector 14 may be directly plugged into a USB connector provided on a computer to function like an externally connected hard disk drive to transmit or store data. When the connector 14 is unplugged, the portable storage device can be carried by a user to any other place or be connected to another computer. Therefore, the portable storage device is highly mobile and convenient for use.

The connector 14 of the above-described conventional portable storage device is connected to an end of the case 16, and is protected by the cover 12 against uselessness resulted from collision, damage, distortion or deformation of the connector 14. During usage, the cover 12 may be taken off from the case 16 and easily lost. Once the cover 12 is lost, the connector 14 is no longer suitably protected and tends to become damaged, failed, and unusable.

Hence, how to improve the disadvantage in prior art is the major discussion of the present invention.

BRIEF SUMMARY OF THE INVENTION

Accordingly, it is an object of the present invention to provide a portable storage device with a protective cap to protect a USB connector thereof, further to avoid loosing protective cover in prior art.

In order to achieve the above-mentioned object, a portable storage device with protective cap includes a memory device with a USB interface and a protective cap detachably mated with the USB interface. The USB interface has a holding section. The protective cap has a case, a spring member mounted therein and a button engaged the spring member. The spring member defines a hook section thereon to engage with the hole of the USB interface. To press said button inwardly disengages the hook section of the spring member from the hole of the USB connector, thereby detaching the USB interface from the cap.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
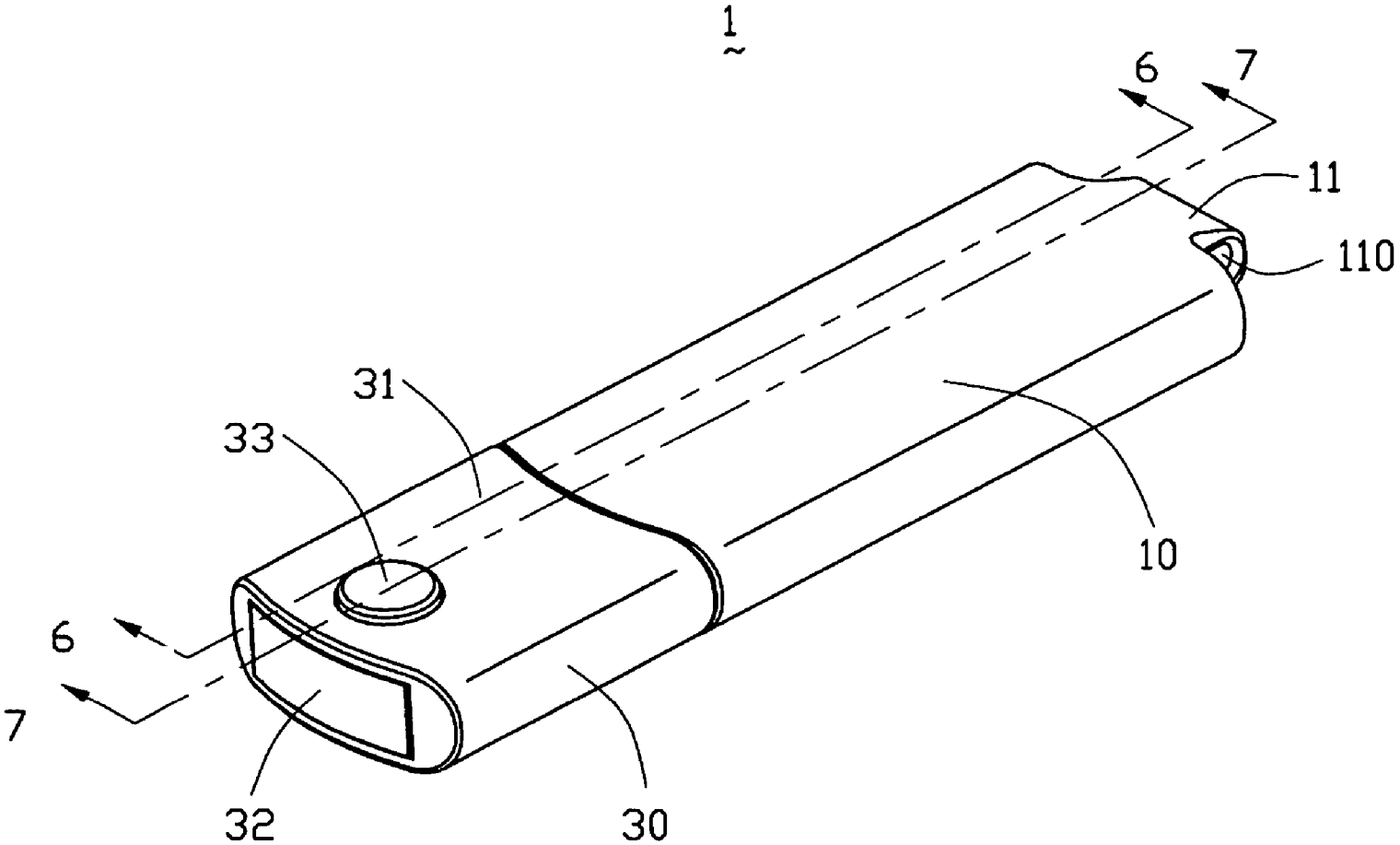
FIG. 1 is a perspective schematic view of a portable storage device with a protective cap in accordance with the preferred embodiment of the present invention.

Reference will now be made to the drawing figures to describe the present invention in detail.

Figure 4:
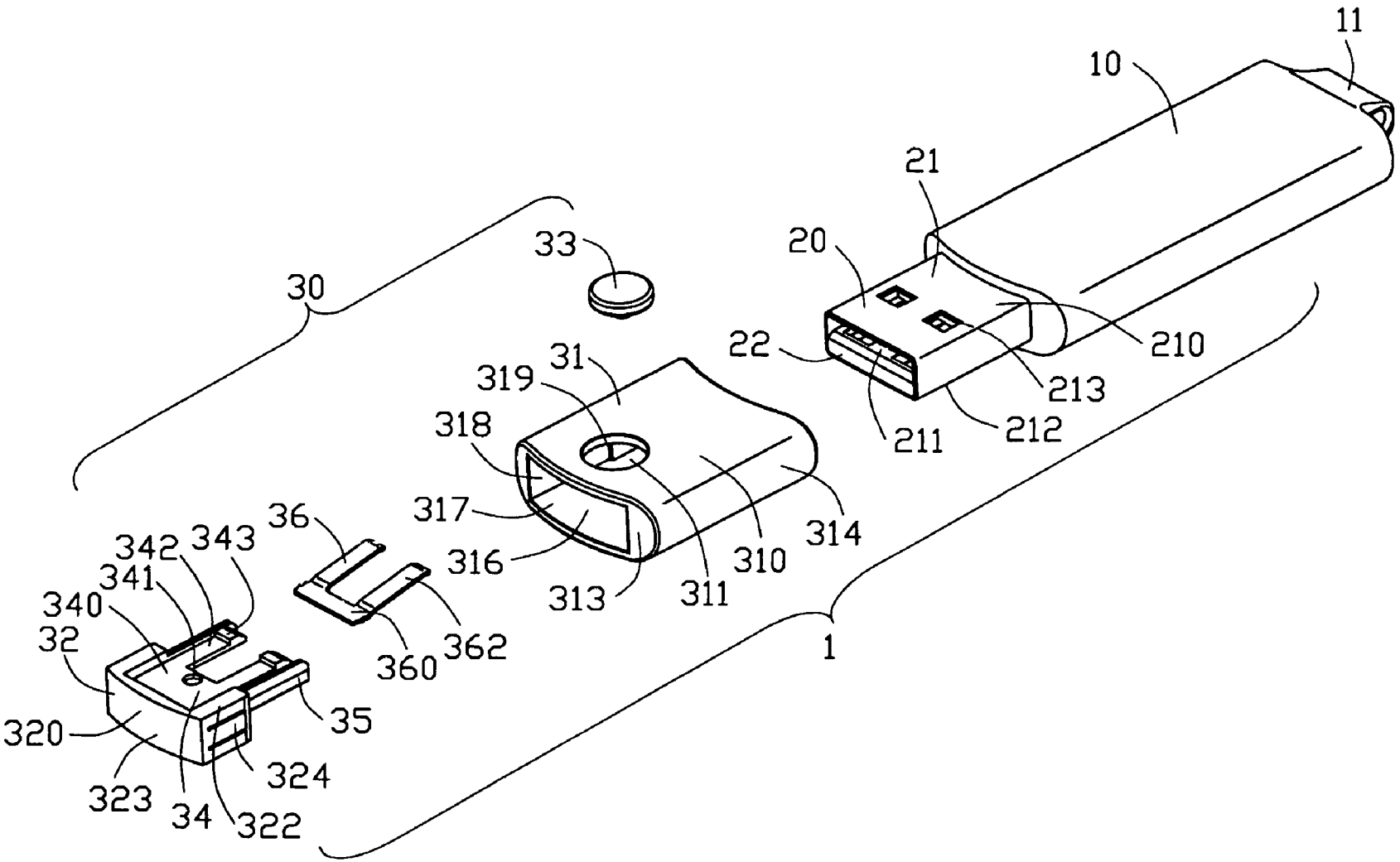
FIG. 4 is a exploded perspective view of the protective cap shown in FIG. 1, showing the protective cap detached from the USB connector.
Figure 5:
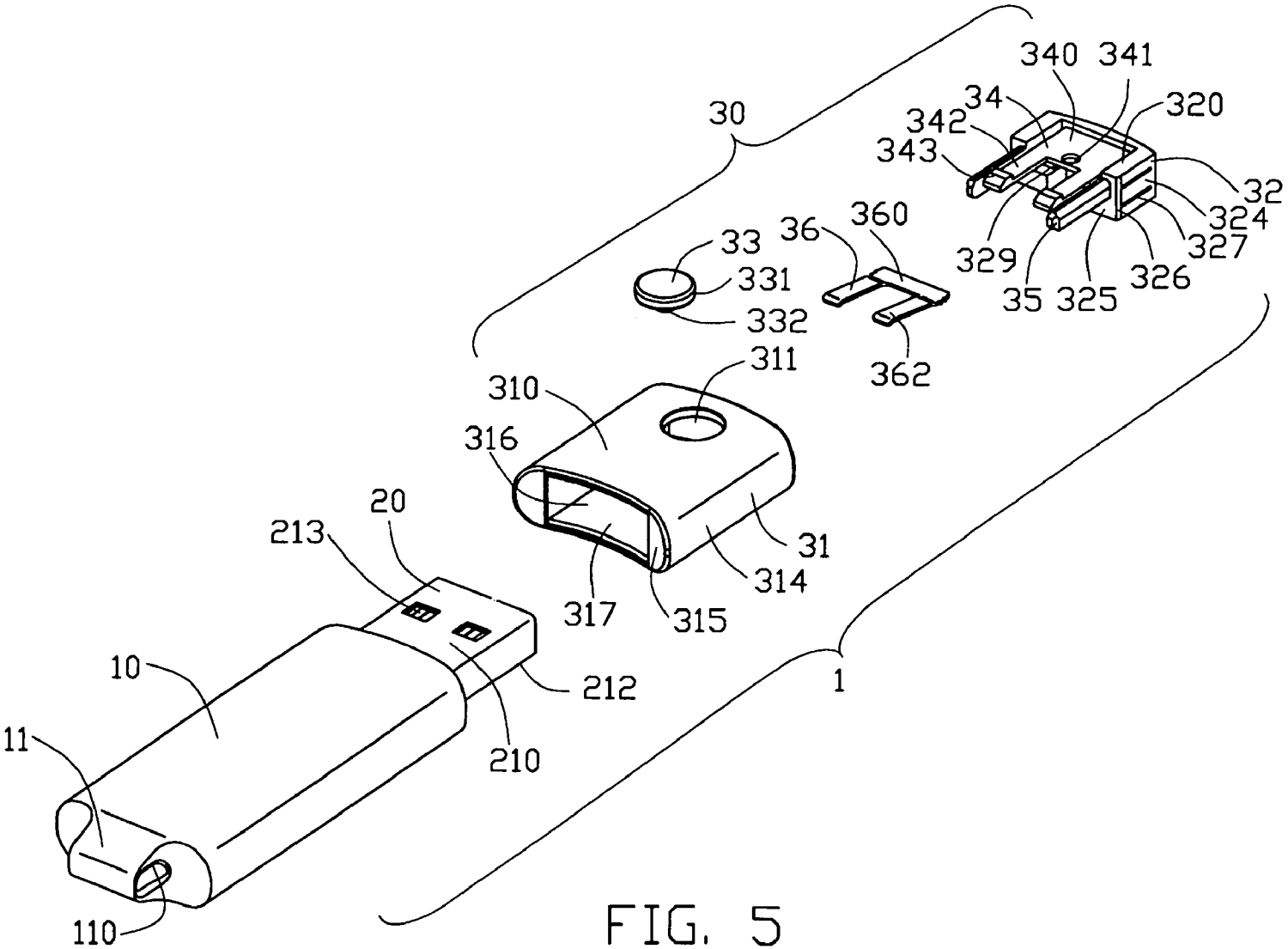
FIG. 5 is similar to FIG. 4, but viewed from another aspect.

With reference to FIGS. 1, 4 and 5, a portable storage device 1 in accordance with the present invention comprises a cartridge member 10, a printed circuit board with a memory unit (not shown) received in the cartridge member 10, a USB connector 20 electrically connecting with the printed circuit board, and a protective cap 30 detachably mated with the USB connector 20.

The cartridge member 10 extending in a front-to-rear direction. One end of the cartridge member 10 is equipped with an outward projecting protrusion 11 with a through hole 110 defined therein, for a string or a key ring passing therethrough and tied to facilitate user's carrying of the storage device 1. Another end of cartridge member 10 is provided with the USB connector 20. The USB connector 20 may has a conventional structure, which includes a substantial rectangular metal shell 21, a mating set 22 received in the shell 21 and a plurality of contacts (not labeled) arranged on the mating set 22. The metal shell 21 defines a top wall 210 and a bottom wall 212. A receiving space 211 is defined between the top wall 210 and the receiving set 22. A holding section is defined in the top wall 210 of the metal shell 21 of the USB connector 20. In this embodiment, the holding section is a pair of through holes 213 defined in the top wall 210 as shown in FIGS. 4 and 5.

Figure 6:
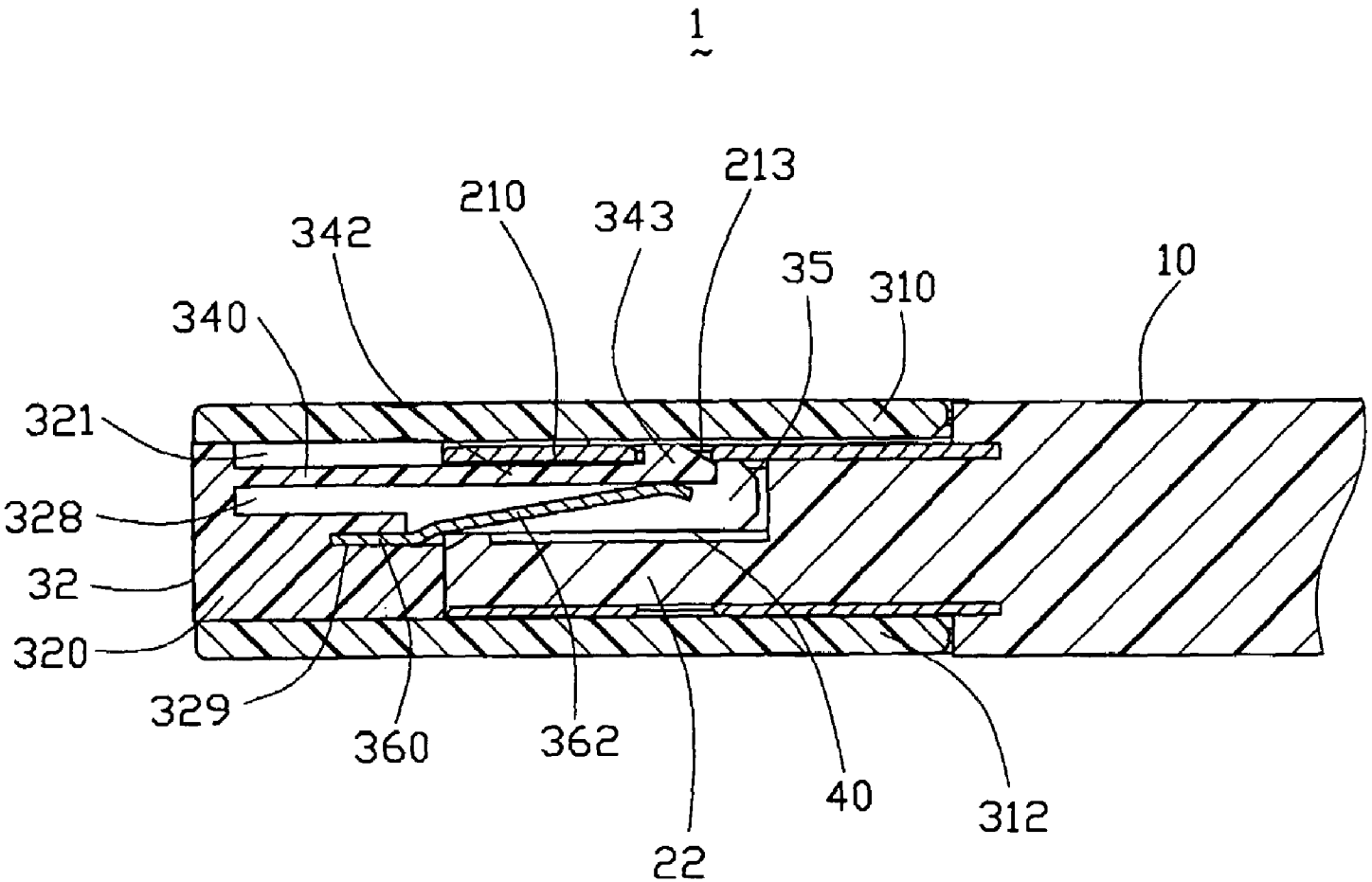
FIG. 6 is a partial sectional view taken along line A—A of FIG. 1, showing relations between the USB connector and the spring arms and the secondary spring arms.
Figure 7:
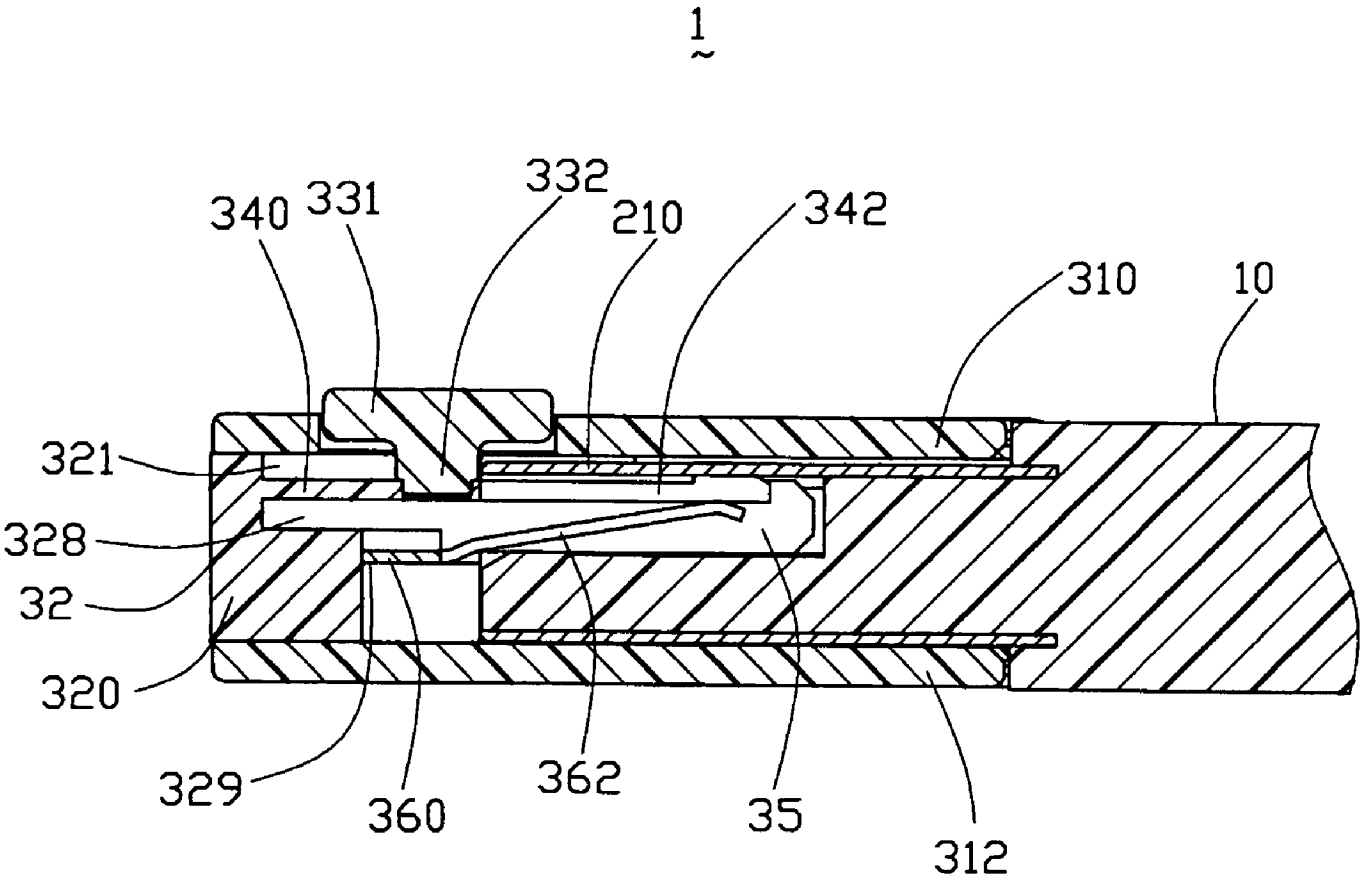
FIG. 7 is a partial sectional view taken along line B—B of FIG. 1, showing relations between the button and the spring arms.
Figure 8:
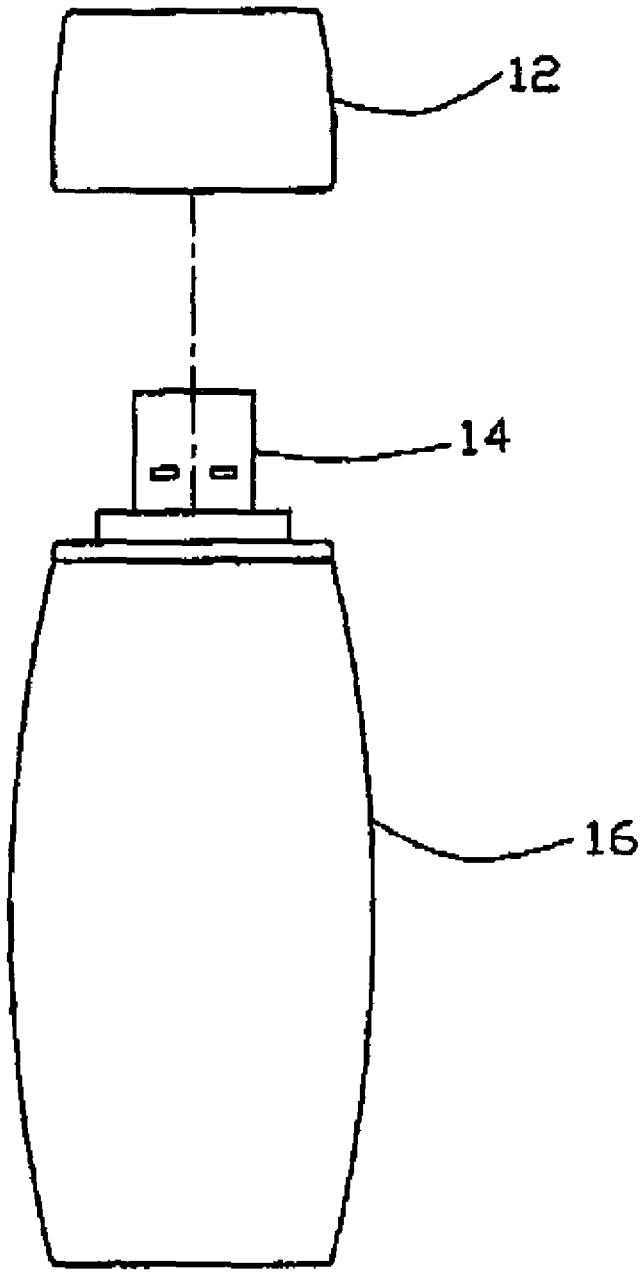
FIG. 8 (PRIOR ART)
FIG. 8 is a schematic diagram of a portable storage device in prior art.

Referring to FIGS. 4 and 5 in conjunction with FIGS. 6 and 7, the protective cap 30 includes a case 31, a chamber 316 enclosed by the case 31, an actuated member 32 received in the chamber 316 and an actuation member 33 engaged with the actuated member 32. The case 31 has a top wall 310 with a through hole 311 defined therein, a bottom wall 312, a pair of opposite sidewalls 314 and opposite front end 313 and back end 315. The two ends both define an opening 317 therein, in communication the chamber 316. Each of the inner surfaces 318 of the sidewalls 314 is formed with a stopper portion 319 in a manner of step in this embodiment.

The actuated member 32 includes a base portion 320 with a top face 322, a front end 323, a rear end 325 and a pair of sidewalls 324. The sidewall 324 is embossed with a pair of projecting ribs 327. An inclined engaging portion 326 is provided at the mutual boundary of the sidewall 314 and the rear end 325 for engaging the stopper portion 319 of the case 31. Two groove 321, 328 are defined in the base portion 320.

The two grooves both parallel to the top face 322 of the base portion 320 and the groove 321 is above the groove 328. A spring member 34, which is sandwiched by the two grooves 321, 328, extend rearwardly from the base portion 320 and beyond it in the front-to-rear direction. In this preferred embodiment, the spring member 34 and the base portion 320 are molded integrally. Of course, in other embodiment the spring member 34 and the base portion 320 may be two things but assumed together as a whole one. The spring member 34 includes a main connection portion 340 connecting the base portion 320, a pair of spring arms 342 extending therefrom and beyond the connection portion 320 in the front-to-rear direction with a projecting hook section 343 formed at free end thereof. A pair of guiding arms 35 extends rearwardly from the rear end 325 in the extending direction of the spring arms 342, and which is outside of the spring arms 342. Corresponding to the through hole 311 in the top wall of the case 31, a hole 341 is defined in the connection portion 340 in alignment with the through hole 311. Furthermore, there is a slot 329 defined in the base portion 320, which is below the groove 328. The actuation member 33 is a button, which includes a main upper portion 331 fitted in the through hole 311 of the case 31 and an engaging lower portion 332 engaged in the hole 341 of the spring member 34. Diameter of the main upper portion 331 is lager than that of the lower portion 332 of the button 33.

The cap 30 further includes a secondary member 36 engaged in the slot 329 of the base portion 320 of the actuated member 32 (as shown in FIG. 6). The secondary spring member 36 comprises a main portion 360 interferentially received in the slot 329 of the base portion 320 and a pair of spring arms 362 extending upward and rearward from the base portion 360. Free ends of the spring arms 362 of the secondary spring member 36 are against lower surfaces of corresponding spring arms 342 of the spring member 34.

Turning to FIG. 1 in conjunction with FIGS. 4–7, in assembly, the actuated member 32 is inserted into the chamber 316 through the opening 317 defined in the front end 313 of the case 31, with projecting ribs 327 on the side surfaces 324 of the base portion 320 being pressed by inner surface 319 of the sidewalls 314 of the case 31, engaging portion 326 of the base potion 320 being against the stop portion 319 formed in the inner surface 318 of the case 31 for obstructing its further movement toward the rear end 315 of the case 31 and the front end 323 being just matched with the opening 317 defined in the front end 313. As a result, the actuated member 32 is securely fitted in the case, and the front end 323 of the base portion 320 and front wall 313 of the case 31 are coplanar. Then, the engaging lower portion 332 of the actuation member 33 is inlaid in the hole 341 of the main connection portion 340 passing through the through hole 319 defined in the top wall 310 of the case 31. The actuation member 33 engaged with the case 31 and the actuated member 32 together. The upper portion 331 of the actuation member 33 is in the through hole 319 of the case 31 and is exposed outside the case 31 partially for facilitating user's operation. These grooves 321, 328 above and below the spring member 34 provide enough space for its movement in a vertical direction.

Figure 2:
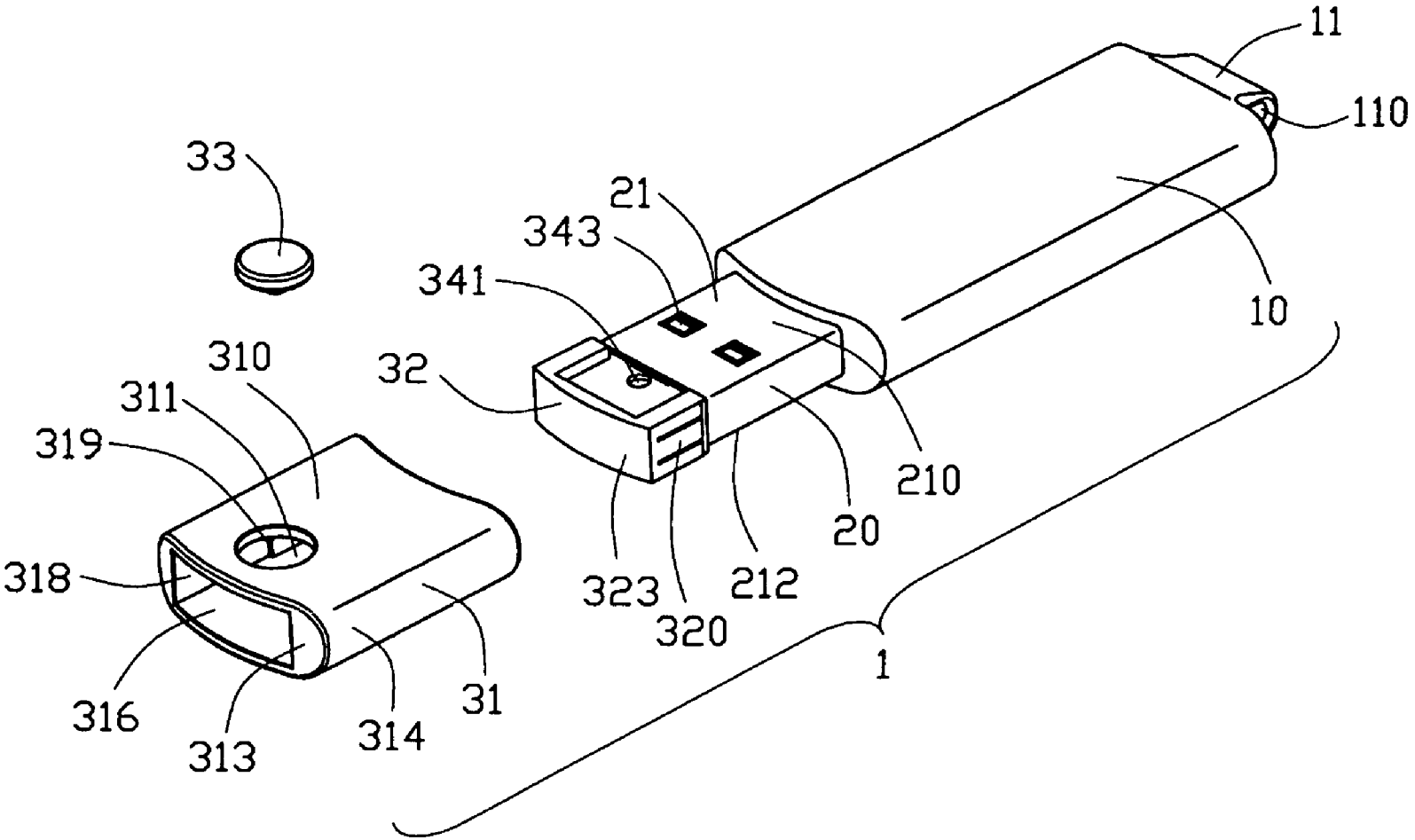
FIG. 2 a partial exploded perspective schematic view of FIG. 1, showing the hook sections engaged with through holes of the USB connector.
Figure 3:
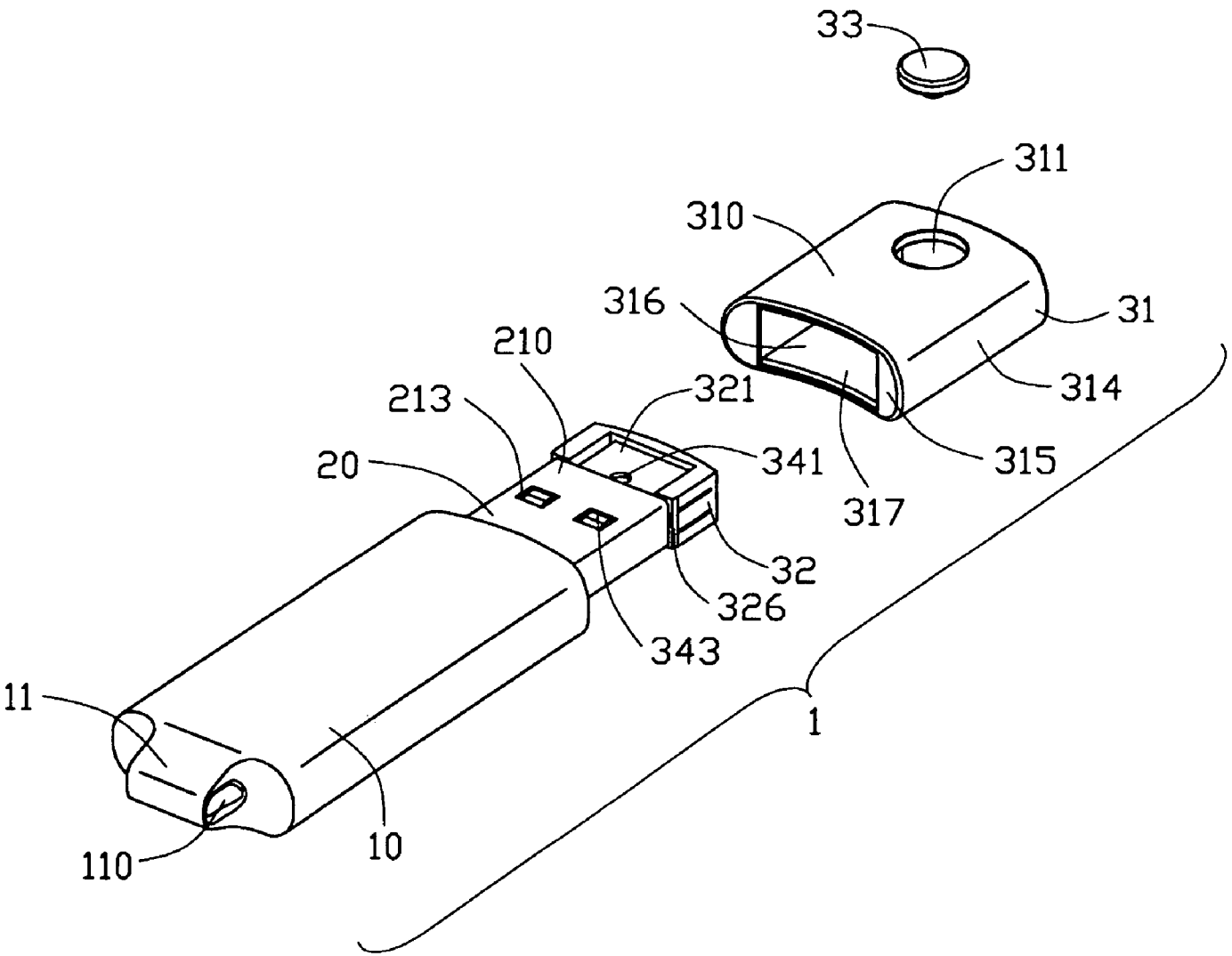
FIG. 3 is similar to FIG. 2, but viewed from another aspect.

Referring to FIGS. 1–3 in conjunction with FIGS. 6–7, in use, the protective cap 30 is to receive and protect the USB connector 20. When the cap 30 mated with the connector, the guiding arms 35 is inserted into the receiving space 211 of the USB connector 20 along an inner sidewall of the USB connector 20, and guide the spring arms 342 into the receiving space 211 too, until a front end of the mating set 22 confront the back end 325 of the base portion 320 of the actuated member 32 and the hook sections 343 are locked by the pair of through holes 213 defined in the top wall 210 of the metal shell 21. In detail, the hook section 343 is first pressed inward and into the receiving space 211. Then, when the hook sections 343 confront the pair of holes 213 in the top wall 210 of the shell 21, the plastic deformation of the pair of spring arms 342 resumes and the hook sections 343 enter the pair of holes 213 and are locked. As a result, the protective cap 30 is assembled with the USB connector 20 firmly. When it is desired to plug the USB connector 20 into another USB connector provided on a computer, the user only need to press the actuation member 33 to actuate the connection portion 340 and the pair of spring arms 342 of the spring member 32 to move downward, which disengages the hook sections 343 from the holes 213 of the metal shell 21. Then, the USB connector 20 is detached from the cap 30 freely.

In view of frequent insertion into and pulling out of the USB connector 20 from the protective cap 30, it is could not be avoided that the elasticity of the spring arm is decreased, influencing the engagement of the hook section 343 of the cap 30 with the USB connector 20. The secondary spring member 36 can solve the problem mentioned above. The pair of spring arms 362 of the secondary spring member 36 is against lower surfaces of corresponding spring arms 342 of the spring member 34 to support the resume of a plastic deformation of the spring arms 342 and ensure the engagement of the hook section 343 of the spring member 34 with the holes 213 defined in the shell 21 of the USB connector 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A portable storage device, comprising:

a cartridge member;

a printed circuit board with a memory unit accommodated in the cartridge member;

a USB connector electrically connected with the printed circuit board, comprising a metal shell, a mating set received in the shell and a plurality of contacts arranged on the mating set, the metal shell defining a top wall, a bottom wall, a holding section and a receiving space defined between said top wall of the shell and said mating set adapted to receive a mating plug;

a protective cap detachably mated with the USB connector, comprising a spring member received therein, said spring member provided with a hook section formed thereon;

wherein the spring member is received in said receiving space of the USB connector and said hook section engages with the holding section and wherein said protective cap comprises an acutation member to be pressed inwardly to disengage the hook section of the spring member from the holding section of the USB connector, thereby detaching the USB connector from the cap.

2. The portable storage device as described in claim 1, wherein said protective cap comprises an actuated member received therein, the actuated member comprising a base portion at frond of the cap, said spring member comprising a connection portion connecting with the base portion.

3. The portable storage device as described in claim 2, wherein the connection portion of the spring member defines a hole therein, the cap comprising a case defining a through hole in a top wall thereof, which is in alignment with the hole in said connection portion, the actuation member be mounted in both the through hole of the case and the hole of the spring member.

4. The portable storage device as described in claim 2, wherein said spring member comprises a pair of spring arms extending rearwardly from the connection portion in a front-to-rear direction with the hook section formed thereat.

5. The portable storage device as described in claim 3, wherein said actuation member comprises an upper portion fitted in the through hole defined in said case and said upper portion exposed outside the case partially.

6. The portable storage device as described in claim 3, wherein said case defines an opening at front end thereof, said base portion with the spring member received in the cap through the opening, a front end of the base portion just matching said opening.

7. The portable storage device as described in claim 6, wherein said case comprises a pair of opposite sidewalls which define a pair of stopper portions thereon, said stopper portions preventing tending movement of the base toward the USB connector.

8. The portable storage device as described in claim 4, wherein said holding section of the USB connector comprises a pair of holes defined in the top wall of the metal shell.

9. The portable storage device as described in claim 4, wherein said actuated member comprises a pair of guide arms extending from the base portion in the front-to-rear direction for guiding said spring arms into the receiving space of the USB connector.

10. The portable storage device as described in claim 4, wherein said base portion of the actuated member defines an upper and a lower grooves therein, the spring member being between said two grooves.

11. The portable storage device as described in claim 10, wherein said base portion of the actuated member defines a slot below said lower grooves, the protective cap comprising a secondary spring member received in the slot to support the spring member.

12. The portable storage device as described in claim 11, wherein said secondary spring member comprises a main portion received in the slot of said base portion of the actuated member, a pair of spring arms extending upwardly and rearwardly to support against lower surfaces of according spring arms of the spring member.

13. A portable storage device assembly, comprising:

a memory device with a USB interface, the USB interface comprising a holding section;

a cap detachably mated with the USB interface, comprising a case defining an opening in a rear end thereof to receive the USB interface, a spring member mounted in the case and a button engaged with the spring member; and wherein the spring member comprises a hook section engaging with the holding section of the USB interface, said button being inwardly movable to disengage the hook section of the spring member from the holding section of the USB connector, thereby detaching the USB interface from the cap.

14. The portable storage device assembly as claimed in claim 13, wherein said button exposes outside the case partially.

15. The portable storage device assembly as claimed in claim 13, wherein said cap comprises a secondary spring member mounted in the case and below the spring member, for supporting against the spring member.

16. A portable storage device assembly, comprising:

an electronic device defining a mating port including an outer metallic shell having therein at least one recessed area which is defined and configured for retainable engagement with an embossment of a complementary connector with regard to said mating port; and a protective cap detachably mated with said electronic device for having said mating port unexposed to an exterior, said cap comprising a spring member which is inserted into said mating port with a hook section outwardly received in said recessed area so as to hold the cap in position with regard to the electronic device;

wherein said spring member is inwardly deflectable for allowing said hook section to be disengaged from the recessed area and thus detaching the cap from the electronic device and wherein said protective cap comprises a button engaging with said spring member, said button being movable inwardly to actuate said spring member inwardly deflectable to disengage said hook section from said recessed area.

* * * * *